US005528353A

United States Patent [19]

Ushio et al.

[11] Patent Number: 5,528,353

[45] Date of Patent: Jun. 18, 1996

[54] TWO-SIDED RECORDING APPARATUS

[75] Inventors: Masaru Ushio; Kazuhisa Maruyama; Junji Sato; Tomoya Motoyoshi, all of Hachioji, Japan

[73] Assignee: Konica Corporation, Tokyo, Japan

[21] Appl. No.: 358,694

[22] Filed: Dec. 19, 1994

[30] Foreign Application Priority Data

Dec. 22, 1993 [JP] Japan ..... 5-324904

[51] Int. Cl.[6] ..... G03G 15/00

[52] U.S. Cl. ..... 355/319; 355/320; 355/24; 271/3.03; 271/3.15; 271/3.17; 271/9.03; 271/65

[58] Field of Search ..... 355/319, 320, 355/23, 24; 271/3.03, 3.15, 3.17, 9.03, 65, 186

[56] References Cited

U.S. PATENT DOCUMENTS

| | | | |
|---|---|---|---|
| 4,978,111 | 12/1990 | Kosugi et al. | 355/319 |
| 5,153,663 | 10/1992 | Bober et al. | 355/319 |
| 5,166,738 | 11/1992 | Tani | 355/308 |
| 5,331,386 | 7/1994 | Mizubata et al. | 355/319 |
| 5,381,220 | 1/1995 | Acquaviva et al. | 355/319 X |

FOREIGN PATENT DOCUMENTS

| | | |
|---|---|---|
| 58-111955 | 7/1983 | Japan . |
| 59-82247 | 5/1984 | Japan . |
| 59-114227 | 7/1984 | Japan . |
| 62-183471 | 8/1987 | Japan . |

OTHER PUBLICATIONS

English–language abstract for Japanese Patent Appln. No. 59–82247.

English–language abstract for Japanese Patent Appln. No. 58–111955.

*Primary Examiner*—Matthew S. Smith

*Attorney, Agent, or Firm*—Finnegan, Henderson, Farabow, Garrett & Dunner

[57] ABSTRACT

An automatic two-sided recording apparatus having an image forming station to form an image on a recording sheet and a sheet feeder to feed the recording sheets onto the station, includes an intermediate stacker having an inlet through which a recording sheet whose one side has been subjected to recording is stacked thereon by a switchback member provided adjacent to the inlet. The inlet is used also an outlet through which the recording sheet is fed out for recording on the other side thereof by the switchback member through a conveyor. The apparatus further includes a controller that switches between a stackless mode in which the switchback member feeds in the recording sheets the stacker and feeds out onto the station without stacking in the stacker, and a stack mode in which the switchback member feeds in and feeds out from the stacker onto the station after stacking in the stacker. The apparatus further includes a measuring member to measure one copy cycle time in the course of an image forming on one side. The controller determines the number of recording sheets to be handled in the stackless mode and that of recording sheets to be handled in the stack mode, based on the copy cycle time measured and a preset copy quantity, and switches the modes in accordance with the determined number of sheets.

10 Claims, 6 Drawing Sheets

TWO-SIDED RECORDING APPARATUS

BACKGROUND OF THE INVENTION

The present invention relates to an automatic two-sided recording apparatus capable of recording images on both sides of a recording sheet of a sheet type, and particularly to an automatic two-sided recording apparatus capable of processing automatic two-sided recording at high speed.

In the field of image recording apparatuses such as an electrophotographic copying machine and a laser printer, there have been proposed various technologies of an automatic two-sided recording apparatus capable of recording not only on one side but also on both sides of a recording sheet. In a conventional automatic two-sided recording apparatus, an image is recorded on one side of a sheet at an image processing section, then the sheet is stored temporarily in an intermediate stacker (intermediate tray), and the sheet is conveyed again to an image forming section. An automatic sheet circulation-conveying apparatus of this type is disclosed in Japanese Patent O.P.I. Publication Nos. 82247/1984 and 114227/1984.

In the case of a two-sided copy mode for a single sheet, the recording sheet is subjected to one-sided copying, then the recording sheet is ejected out of an apparatus temporarily by an ejection roller to be turned upside down, and is fed to the image forming section again through the aforesaid circulation-conveying path so that copy images are formed on the opposite side of the recording sheet. In the case of two-sided copying for plural sheets, on the other hand, a recording sheet whose one side has been recorded is fed to the image forming section again through the intermediate stacker so that copy images are formed on the opposite side of the recording sheet. With regard to the two-sided copying apparatus that circulation-conveys a single recording sheet and plural recording sheets, Japanese Patent O.P.I. Publication Nos. 111955/1983 and 183471/1987 are known.

The aforementioned publications disclose that a conveyance path which does not pass through an intermediate stacker and a conveyance path which passes through the intermediate stacker are provided for recording on the other side of a sheet whose one side has been recorded, and recording sheets are stacked on the intermediate stacker temporarily and then are conveyed when a plurality of copies are needed. In the aforementioned conventional copying machine, there have been caused disadvantages mentioned below because a sheet conveyance path used for feeding again the sheet stacked temporarily in the intermediate stacker and a sheet conveyance path used for feeding again the sheet directly without stacking are separated independently.

Namely, it is unavoidable that the two-sided copying apparatus is complicated in structure, resulting in production cost increase. Further, switching operations are complicated, which causes occurrence of troubles. Operations of timing in the course of sheet conveyance are also complicated and adjustment therefor is difficult. Therefore, it is unavoidable that reliability of the total apparatus is lowered.

The applicant of the invention have applied U.S. Pat. No. 5,331,386 (Jul. 19, 1994) wherein the disadvantages have been solved and circulation conveyance of recording sheets, conveyance efficiency and a speed of copy processing are improved. The recording sheet conveyance device in the aforementioned publication is represented by a recording sheet conveyance device of a two-sided recording type stacking a recording sheet fed from a sheet supply section in an intermediate tray of the recording sheet conveyance device after image recording on one side of the recording sheet by an image forming section, and conveying further the recording sheet so that images may be recorded on the other side of the recording sheet in the aforementioned image forming section, wherein a sheet-feeding/ejecting means capable of rotating forwardly and reversely for ejecting or feeding the recording sheet to the intermediate tray is provided for the purpose of recording on the other side of the recording sheet whose one side has been recorded, and a recording sheet conveyance path is used in common for both an established stackless mode in which the recording sheet is fed by the aforementioned sheet-feeding/ejecting means again one by one being held by its one end without being stacked in the intermediate tray and an established stack mode in which the recording sheet is stacked in the intermediate tray and then is fed again.

The problem of a conventional copying apparatus is that an interval from copying on the obverse side to copying on the reverse side is extremely long. The reason for this is that copying on the reverse side is started after all the recording sheet are stacked temporarily on an intermediate tray. This problem has been solved in the aforementioned U.S. Pat. No. 5,331,386, and there has been made a proposal for conveying recording sheets wherein a control means including constant A of a master table established in advance based on various conditions of sizes of recording sheets and/or copying magnifications is provided, and conveyance of the recording sheet is conducted by selecting a stackless mode or a stack mode by means of comparison control between the aforementioned sizes of the recording sheets and/or signals of processing sheet quantity and the constant A. However, the above-mentioned master table used in selection of a stackless mode or a stack mode becomes complicated when the copying magnification is one such as a zoom magnification, resulting in fall of reliability. In addition, operations of an optical system and conveyance of recording sheets are varied depending on differences between apparatuses, deterioration with the passage of time and environmental conditions, and reliability is further lowered.

SUMMARY OF THE INVENTION

An object of the invention is to provide a two-sided copying apparatus having a function for preparing a binding margin wherein the aforementioned fall of reliability is prevented, occurrence of jam problems which tend to occur in two-sided copying is prevented, blurred images caused by insufficient time for changing documents which tends to happen when changing documents can be prevented and unnecessary operations for returning documents conducted in suspension caused by no sheet fed from a sheet feeding cassette can be prevented, and it is possible to maintain the substantial copy speed at its appropriate level while keeping conformity and reliability as a system.

The first embodiment of the invention is an automatic two-sided recording apparatus comprising; an image forming means that forms an image on a recording sheet, a sheet-feeding means which conveys a recording sheet from a support tray to the aforementioned image forming means, an intermediate stacker having an inlet through which a recording sheet whose one side has been subjected to recording is stacked thereon, wherein the inlet is used also as an outlet through which the recording sheet is fed out for recording on the other side thereof, a feeding means that feeds recording sheets into the intermediate stacker or feeds out recording sheets contained in the intermediate stacker again, a switchback means that causes a recording sheet to make a switchback movement before the inlet of the intermediate stacker, and a conveyance means that conveys a recording sheet to the image forming means again. Further, the apparatus has a control means that switches between a stackless mode wherein the conveyance means feeds the recording sheet subjected to the switchback movement one by one by the switchback means to the image forming means again without stacking recording sheets in the intermediate stacker and a stack mode wherein the conveyance means feeds a recording sheet one by one again to the image forming means after the recording sheet is fed to be stacked in the intermediate stacker by the feeding means, a copy quantity setting means, a measuring means for measuring one copy cycle time in the course of image forming on one side, and based on the one copy cycle time obtained through the aforementioned measurement and the copy quantity set, the control means determines the number of recording sheets to be handled in the stackless mode and that of recording sheets to be handled in the stack mode, and switches the aforementioned modes in accordance with the determined number of sheets.

The second embodiment of the invention is represented by the aforementioned embodiment 1 comprising further a returning control means that corrects the returning timing of a scanning optical system, and a measuring means that measures the arrival time required for the sheet taking the lead in a stackless mode to arrive at the switchback means, and is characterized in that the timing for the scanning optical system after the last exposure for recorded image forming on one side to start returning is adjusted based on the arrival time measured.

The third embodiment of the invention is represented by the first embodiment wherein an interval between the first sheet taking the lead in the stackless mode and the last recording sheet whose one side has been subjected to recording is not less than a distance between continuously conveyed recording sheets adjoining each other in the apparatus in the aforementioned embodiment 1.

The fourth embodiment of the invention is represented by the first embodiment wherein an interval between the first sheet taking the lead in the stackless mode and the last recording sheet whose one side has been subjected to recording is longer than a distance which a recording sheet covers within the time required for document replacement.

The fifth embodiment of the invention is represented by the aforementioned first embodiment wherein the number of recording sheets handled in the stackless mode is determined by the length from the support tray to the switchback means.

The sixth embodiment of the invention is represented by the aforementioned first embodiment wherein the number obtained by subtracting one from the number of recording sheets handled in the stackless mode is determined so that the number of sheets may exist between the support tray and the switchback means.

The seventh embodiment of the invention is represented by the aforementioned fifth embodiment wherein a detecting means for detecting the existence of the recording sheet on the support tray is further provided, and no recording sheet is detected by the timing wherein the first recording sheet taking the lead in the stackless mode is detected before it reaches the switchback means.

The eighth embodiment of the invention is represented by the aforementioned seventh embodiment wherein all recording sheets existing in the conveyance path are stored temporarily in the intermediate stacker when no recording sheet is detected by the above-mentioned detecting means in the stackless mode.

The ninth embodiment of the invention is represented by the aforementioned first embodiment wherein a means for forming a binding margin by shifting the position for forming an image on a recording sheet is further provided, and the number of recording sheets to be handled in the stackless mode is determined depending on the amount of shifting of the image forming position.

The tenth embodiment of the invention is represented by the aforementioned first embodiment wherein the number of sheets set is equal to the number of sheets handled in the stackless mode plus the number of sheets handled in the stack mode.

(a) As stated above, it is possible to optimize the number of sheets to be stacked/the number of sheets not to be stacked by measuring and calculating a normal copy interval which is to be basic data while making copies. Namely, by measuring one copy cycle in the course of copy operations, it is possible to determine the number of sheets not to be stacked to the optimum value, without storing in ROM the infinite number of cycle time derived from a combination of sheet sizes and magnifications and without increasing loads of preparing software because fluctuation of one copy cycle time caused by differences between apparatuses and those in environmental conditions can be absorbed.

(b) With regard to a stackless sheet which does not stop temporarily at all during its circular movement that starts from a registration roller when the roller is turned on and ends by returning to the same registration roller again, it is considered that the time required for the circular movement varies depending on the environmental conditions in an apparatus, quality of the sheet used and a difference between apparatuses. Therefore, the necessary time for conveying the stackless sheet is measured, and timing control with a scanning optical system is conducted based on data of the measurement. Owing to this control, occurrence of a jam is prevented and trouble such as timing delay can be prevented.

Further, in stack and stackless operations, it is necessary to bring them close to natural conditions of high speed processing. To be concrete, it is necessary to satisfy the following three conditions for the operations.

(1) A distance between the first sheet and the last sheet whose one side has been recorded in a stackless mode needs to be minimum provided that the distance does not fall below the ordinary copy interval. (When the control is made so that this condition is satisfied, the rear-end collision is prevented and the optimum speed is assured.)

(2) An interval in terms of time between the first sheet and the last sheet whose one side has been recorded in a stackless mode needs not to be shorter than the necessary time for changing documents. (When the control is made so that this condition is satisfied, a phenomenon of blurred images caused by insufficient time of changing documents can be prevented.)

(3) Sheet-supply suspension should not take place after the first sheet has traced a switchback. (When no recording sheet in a sheet-feeding section is detected before the first sheet taking the lead in the stackless mode is subjected to the switchback movement, it is possible to instruct the supply of recording sheets by shunting the recording sheet to the intermediate stacker. However, when the recording sheets are used up after the switchback movement, the document is changed before the recording is made on the obverse side for the recording sheets in quantity established for recording on the reverse side for recording sheets each being subjected to the switchback movement. As a result, when supplying recording sheets, one document needs to be returned. Namely, the document-returning operation required after the suspension for sheet supply is made unnecessary by controlling so that the above-mentioned condition can be satisfied.)

Further, in the two-sided copying apparatus of the invention, it is possible to set a mode for a binding margin, and when a value of the binding margin is established, the timing of the start for returning the optical system and the number of sheets not to be stacked are compensated based on the value of the binding margin. Therefore, it is possible to prevent a rear-end collision and a jam of a recording sheet in the same way as in ordinary copying.

DETAILED DESCRIPTION OF THE PREFERRED EMBODIMENT

Figure 1:
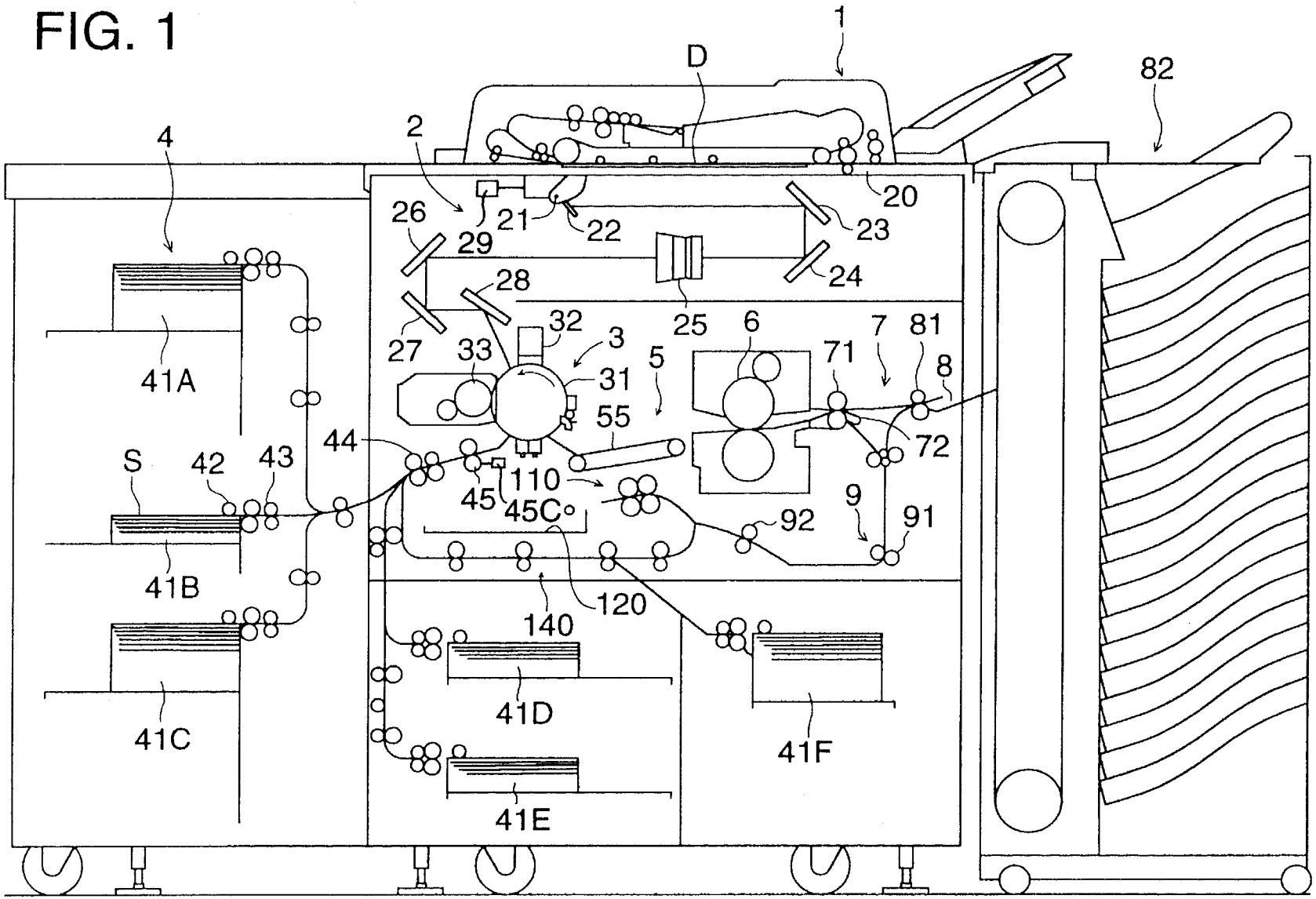
FIG. 1 is a schematic structural diagram showing an example of a two-sided copying apparatus of the invention.

Next, an example of the two-sided copying apparatus of the invention will be explained as follows, referring to the drawings attached.

Figure 2:
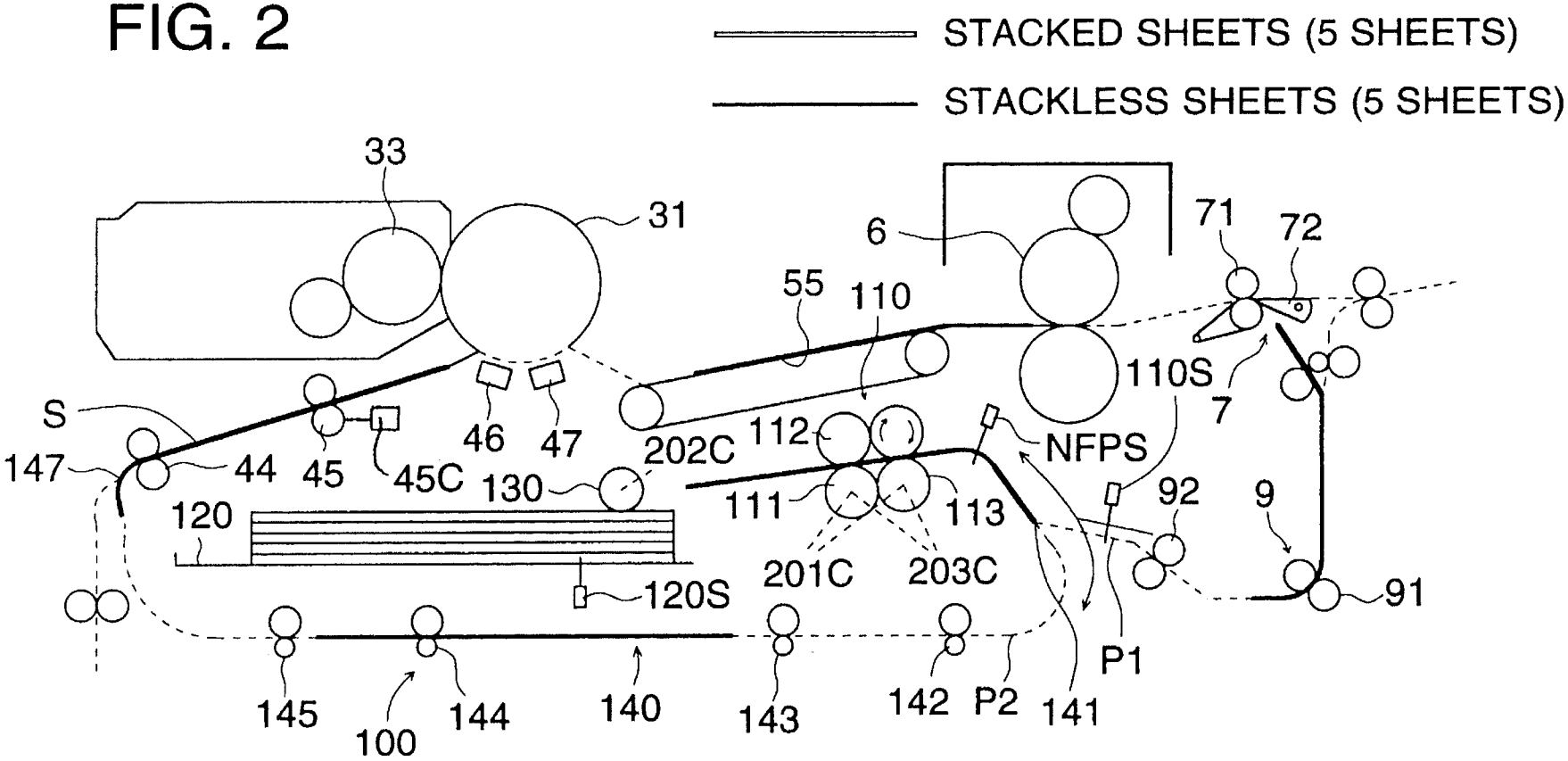
FIG. 2 is a diagram of primary parts showing the sheet conveyance path in the two-sided copying apparatus shown in FIG. 1.

FIG. 1 is a schematic structural diagram of the two-sided copying apparatus, and FIG. 2 is a diagram of primary parts showing the sheet conveyance path in the two-sided copying apparatus shown in FIG. 1.

In the figure, the numeral 1 is an automatic document feeding unit equipped with a function to reverse a two-sided document automatically, 2 is a scanning exposure optical system, 3 is an image-forming means provided around photoreceptor drum 31, the numeral 4 is a recording sheet feeding means, 5 is a conveyance means for recording sheets, 6 is a fixing unit, 7 is a reversal-ejection switching means, 8 is an external sheet ejection means, 9 is the first reversing/conveying means and 100 is an intermediate stacker sheet feeding unit.

An image on document D placed on document table 20 is illuminated by exposure lamp 21 of the scanning exposure optical system 2, then led to lens 25 through mirrors 22, 23 and 24 which move for scanning, and is further led, through mirrors 26, 27 and 28, to photoreceptor drum 31 that is charged entirely by charging unit 32 in advance where a latent image is formed. The latent image is developed by developing unit 33 to be a toner image.

On the other hand, recording sheet S that is selected from either one of plural sheet feeding trays 41A–41F and fed by those including pickup roller 42, double feed preventing sheet feeding means 43 composed of a feed roller and a reverse roller, and intermediate roller 44, is synchronized by registration roller 45 connected with registration clutch 45C and is fed so that the toner image is transferred by transfer unit 46 onto the recording sheet S. The recording sheet S having thereon the toner image after transferring is separated from the photoreceptor drum 31 by separating unit 47 and is fed, through conveyance belt 55 of conveyance means 5 for the recording sheet, to fixing unit 6 to be fixed. The recording sheet S after being fixed passes through conveyance roller 71 and switching gate 72 both of the reversal-ejection switching means 7 and is ejected, through sheet ejecting roller 81, onto a bin of sorter 82 that is positioned outside the apparatus when copying just on one side without copying on both side. Thus, the copying cycle is completed.

The reversal-ejection switching means 7 selects a feedout path for recording sheet S to the side of the intermediate stacker sheet feeding unit 100 or that to the side of sorter 82 depending on whether a selection button is operated for one-sided copying or for two-sided copying.

In the case of conveyance in a stack mode for two-sided copying, the recording sheet S on which the first image of a document has been transferred and fixed is led by the reversal-ejection switching means 7 to conveyance rollers 91 and 92 of the first reversing/conveying means 9 and enters the intermediate stacker sheet feeding unit 100.

The intermediate stacker sheet feeding unit 100 is installed under image-forming drum 31 at the downstream side in the direction of conveyance of the first reversing/conveying means 9. The intermediate stacker sheet feeding unit 100 is composed of switchback means 110, intermediate stacker 120, sheet feeding roller 130 that re-feeds recording sheet S to the intermediate stacker 120, and second reversing/conveying means 140 installed under the intermediate stacker 120.

The switchback means 110 is provided with driving roller 111 that is connected with a driving source and is capable of rotating forwardly and reversely and with reverse roller 112 having a built-in one-way clutch Or a torque limiter which is in pressure-contact with the driving roller 111 to be driven thereby to rotate (forwardly) when a recording sheet is introduced and to rotate reversely when the recording sheet is ejected. Conveying roller 113 adjoining the roller mentioned above rotates forwardly and reversely. Between junction 141 which will be explained later and the reversing-conveying means 9 at its downstream side, there is provided sensor 110S that detects recording sheet S fed into the switchback means 110. Further, a no-feed sensor (NFPS) that detects existence of sheet S led or ejected to switchback means 110 is provided in the vicinity of an inlet of the switchback means 110.

When recording sheet S is conveyed into the intermediate stacker 120 from the first reversing/conveying means 9, stack clutch 201C that is connected to the conveying roller 113 to rotate the same in the introduction direction is ON to be in the state of engagement, and the conveying roller 113 and driving roller rotate in the introduction direction. In this case, the reverse roller 112 is driven to rotate, but when ejecting the recording sheet from the intermediate stacker 120, sheet-re-feeding clutch 203C that makes driving roller 111 to rotate in the ejecting direction and feed-out clutch 202C that makes feed-out roller 130 to rotate in the feed-out direction are ON to be in the state of engagement so that the reverse roller 112 is rotated reversely against its conveying direction or is stopped. Therefore, double feeding of sheets is prevented and the separated recording sheet S is fed out to the second reversing/conveying means 140 while being sandwiched between conveying rollers 113 rotating in the sheet-ejecting direction. At junction 141 for a guide plate outlet port on the downstream side of conveying roller 92, which is located at the downstream side in the conveying direction of the switchback means 110, there is provided a flexible-film-shaped switching member. This switching member makes the recording sheet having passed the conveying roller 92 possible to advance to the side of the switchback means 110 through path P1, and prevents the recording sheet from flowing backward to the previous path P1 when the recording sheet is conveyed out of the switchback means 110 that makes the recording sheet to perform switchback and is fed again to the second path P2 for reversing/conveying.

On the second path P2, there is provided second reversing/conveying means 140 that is composed of plural pairs of conveying rollers 142, 143, 144 and 145 which are capable of rotating to drive as well as of meeting point 147 that meets with a conveyance path for sheet S conveyed from a sheet-feeding tray. All of the pairs of conveying rollers 142, 143, 144 and 145 respectively consist of a driving roller and a driven roller, and an interval between roller pairs is established to be shorter than the length of a recording sheet of the minimum size.

The recording sheet conveyed by pairs of the conveying rollers 142, 143, 144 and 145 of the second reversing/conveying means 140 while being sandwiched between them is then conveyed toward the meeting point 147, and the recording sheet thus ejected passes through intermediate conveying roller 44 and registration roller 45 and is ejected onto a bin of sorter 82 through reversing/ejecting switching means 7 wherein a change of the conveyance direction is set, after the recording sheet is subjected to image formation on its reverse side.

Next, in the case of conveyance in a stackless mode for two-sided copying, the recording sheet which has been subjected to image recording on its one side is led by reversal-ejection switching means 7 to the first path P1 and then is sandwiched between conveying rollers 113 of the switchback means 110. In this case, stack clutch 201C is ON to be in the state of engagement, and thereby both driving roller 111 and conveying roller 113 are rotating in the direction for introducing a sheet to intermediate stacker 120. After a given period of time from the moment when the trailing edge of a recording sheet was detected by sensor 110S, the conveying roller 113 of the switchback means 110 is switched to its reverse rotation while it is holding the recording sheet. Namely, the stack clutch 201C is turned OFF to be disengaged and the sheet-re-feeding clutch 203C is turned ON to be engaged. In this case, the sheet is sandwiched by the conveying roller 113 that is rotating in the direction of sheet ejection and is fed out to the second reversing/conveying means 140. After that, the conveying rollers 113 of the switchback means 110 sandwiches, in the same manner as in the foregoing, the next recording sheet which has been subjected to image recording on its one side, and the recording sheet is fed out to conveyance path P2 for sheet-re-feeding which is the second path, after being reversed through switchback operation.

In this stackless mode, the number of recording sheets S which can be processed in one cycle is limited to the number of sheets contained contemporaneously in conveyance path P1 for sheet-reversing and conveyance path P2 for sheet-re-feeding at prescribed intervals because sheets are not stacked on intermediate stacker 120 under the stackless mode. Incidentally, FIG. 2 shows two-sided copying operations with the established number of sets of 10 wherein the first five sheets are stacked on intermediate stacker 120 and next five sheets are being conveyed through conveying paths P1 and P2 under the stackless mode.

In a two-sided copying apparatus of the invention, a stack mode and a stackless mode are combined so that the ratio of the number of sheets to be stacked to that of stackless sheets may be made optimum for the set quantity of copies, and switching from the obverse side copying to the reverse side copying is made possible at the intervals which are almost the same as those in continuous copying.

Figure 3:
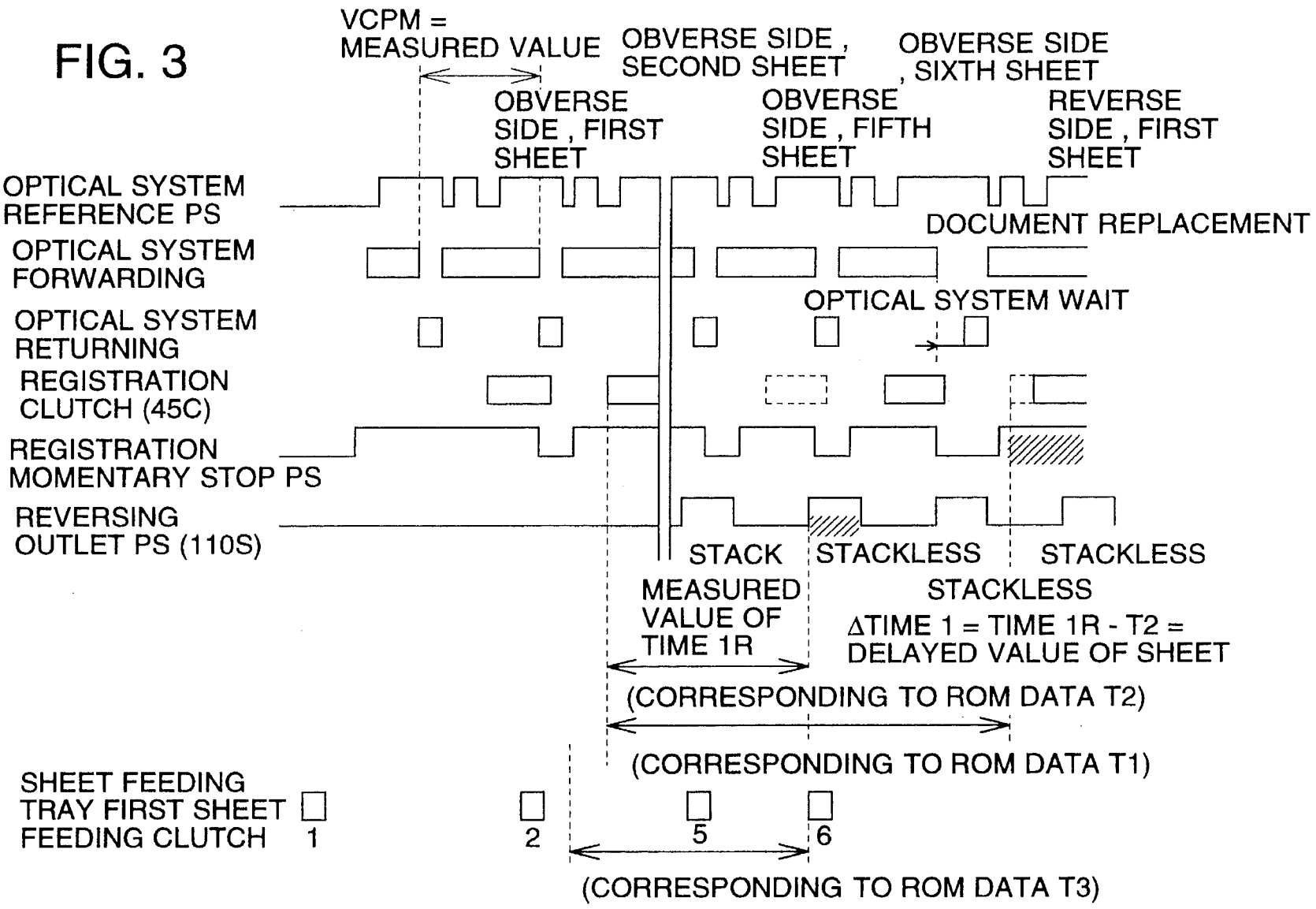
FIG. 3 is a time chart related to the invention.
Figure 4:
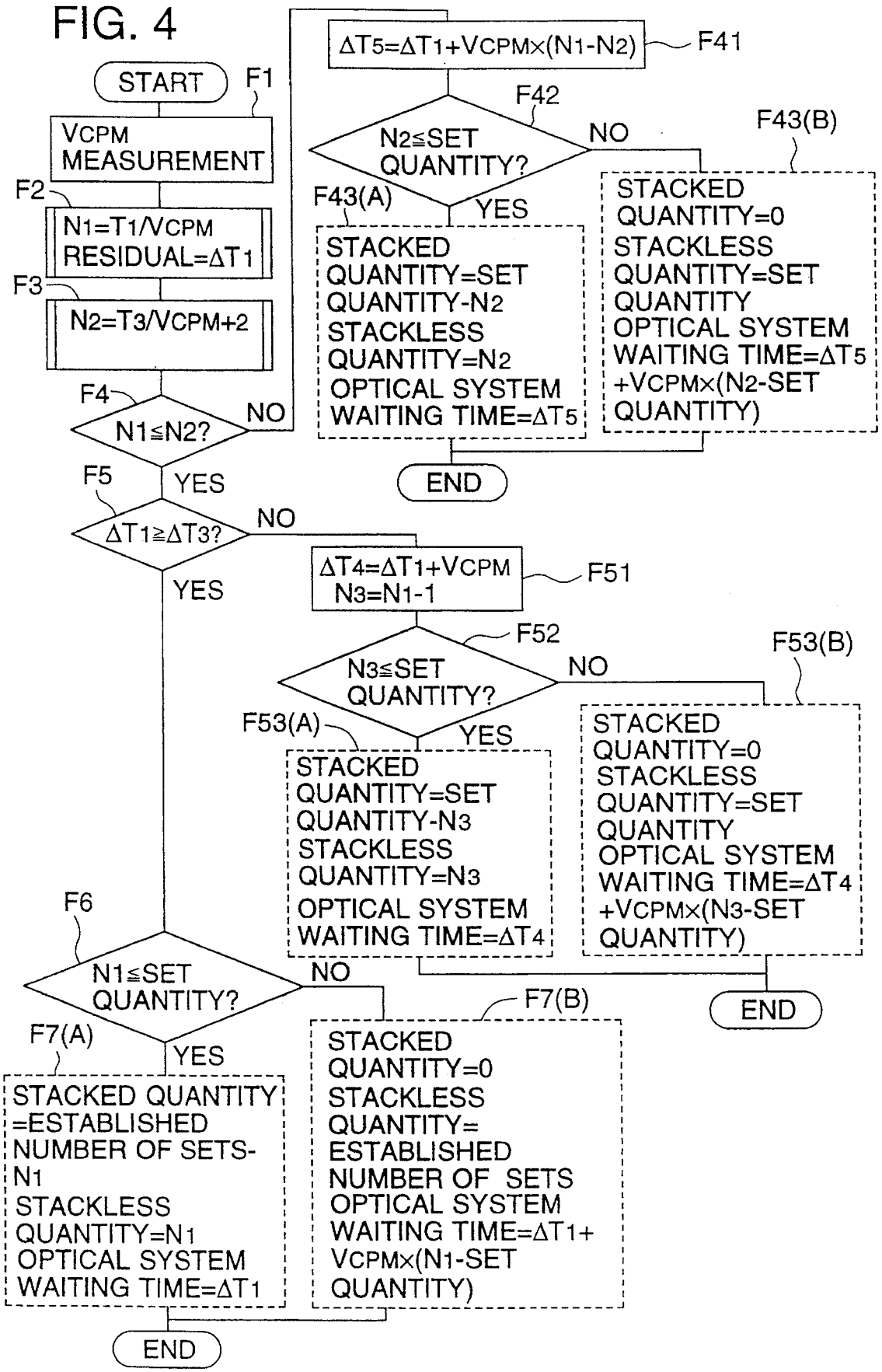
FIG. 4 is a flow chart used for establishing the number of sheets to be stacked, the number of sheets not to be stacked and waiting time of an optical system.

FIG. 3 is an example of a time chart related to the invention illustrating that a single sheet is stacked and five sheets are in stackless for the established number of sets of six. FIG. 4 is a flow chart showing how to establish the number of sheets to be stacked and the number of stackless sheets as well as the waiting time for an optical system in switching from the obverse side copying to the reverse side copying.

When conditions of two-sided copying are established and a copy button is turned ON, scanning optical system 2 starts operating, and optical scanning for the obverse copying on the first sheet is performed first following the prescanning for detecting document density and others. In this case, a sensor 29 provided in the vicinity of the optical system, as shown in FIG. 1, measures the time ($V_{CPM}$) for one copy cycle (F1).

One copy cycle time mentioned in this case is concretely defined as an interval between a scanning cycle and the subsequent scanning cycle of an optical system shown when a document is scanned continuously by the optical system (time required for one scanning).

Then, an access is made from ROM for the time ($T_1$) necessary for the recording sheet to travel round the stackless path which is the fastest value of "registration ON–switchback–registration arrival time+waiting time (0.2 sec)", and calculation of $N_1=T_1/V_{CPM}$ ($N_1$ is an integer) is made. In this case, $N_1$ is the number of stackless sheets obtained from the condition of preventing a rear-end collision, and the residue=$\Delta T_1$ produced in the aforementioned calculation is the waiting time of the optical system since $N_1$ is an integer (F2).

Incidentally, the waiting time of an optical system is a period of time during which the optical system does not participate in copying, namely, it is a period for which the optical system is on standby.

Next, there is made calculation through $N_2=T_3/V_{CPM}+2$ for the number of stackless sheets ($N_2$) for preventing that document replacement is accidentally made when there is no sheet on sheet feeding tray 41A, for example, from which the sheet is to be fed (F3).

Owing to this, when a sensor provided on each of sheet-feeding trays 41A–41F detects, by some rare accident, no recording sheet in a sheet-feeding section (not shown) before the first sheet taking the lead in the stackless mode is subjected to the switchback movement, all recording sheets for stackless use are shunted to the intermediate stacker to be on standby until recording sheets are supplied. Therefore, it is prevented that a document is changed due to the detection of no sheet before the recording sheet in set quantity have been subjected to recording.

Incidentally, it is preferable that an unillustrated operation unit or a warning device gives an instruction for supplying recording sheets during the period of standby.

In this case, $T_3$ is the time necessary for the sheet to cover the distance from the selected sheet feeding tray 41A to the reversing outlet, and it is a value called from ROM.

Now, the number of sheets ($N_1$) obtained from the condition for preventing a rear-end collision will be compared with the number of sheets ($N_2$) obtained from the prevention of document replacement made accidentally when there is no sheet (F4).

When the relation of $N_1 \leqq N_2$ is satisfied, optical system waiting time ($\Delta T_1$) is compared with waiting time ($\Delta T_3$) that is stored in ROM and is necessary for document replacement (F5) for the purpose of preventing blurred images which look like a running image caused by the fact that a document is scanned while it is being replaced (while it is moving) without being exposed correctly.

When the relation of $\Delta T_1 \geqq \Delta T_3$ is satisfied, blurred images are not caused. Therefore, the number of sheets ($N_1$) obtained from the condition of preventing a rear-end collision is compared with the established number of sets (F6), and the number of sheets to be stacked, the number of stackless sheets and optical system waiting time are determined from the results of the comparison (F7 (A), F7 (B)).

In the flow of F4, when the relation of $N_1 > N_2$ is satisfied, optical system waiting time ($\Delta T_5$) is calculated through the calculation expression of $\Delta T_5 = \Delta T_1 + V_{CPM} \times (N_1 - N_2)$ (F41).

Then, the number of sheets ($N_2$) obtained from the prevention of document replacement made accidentally when there is no sheet is compared with the established number of sets (F42), and the number of sheets to be stacked, the number of stackless sheets and optical system waiting time are determined temporarily from the results of the comparison (F43 (A), F43 (B)).

In F5, when the relation of $\Delta T_1 < \Delta T_3$ is satisfied, calculation of optical system waiting time ($\Delta T_4$) through a calculation expression of $\Delta T_4 = \Delta T_1 + V_{CPM}$ and calculation of the number of stackless sheets ($N_3$) through a calculation expression of $N_3 = N_1 - 1$ are made (F51), then the number of stackless sheets $N_3$ obtained from the flow of F51 is compared with the established number of sets (F52), and the number of sheets to be stacked, the number of stackless sheets and optical system waiting time are determined from the results of the comparison (F53 (A), F53 (B)).

Now, copy operations based on the time chart shown in FIG. 3 are made with the number of sheets to be stacked and the number of stackless sheets both determined by the flow chart shown in FIG. 4. In this case, the time (TIME 1R) that is necessary for the first stackless sheet to reach sensor 110S provided on the reversing output of the switchback means 110 of the intermediate stacker 120 from ON of registration clutch 45C is measured and is compared with reference data ($T_2$) for the movement distance stored in ROM to be the same as above. The speed for conveying a recording sheet tends to be lower than the standard data due to a slip and others, and the delay of the recording sheet is calculated by the following expression.

$$\Delta \text{TIME } 1 = \text{TIME} 1R - T2$$

Therefore, the optical system waiting time (DWAT B1) obtained from a flow chart in FIG. 4 is corrected by the following expression.

$$\text{Optical system waiting time} = \text{DWAT } B1 + \Delta \text{TIME } 1$$

Figure 5:
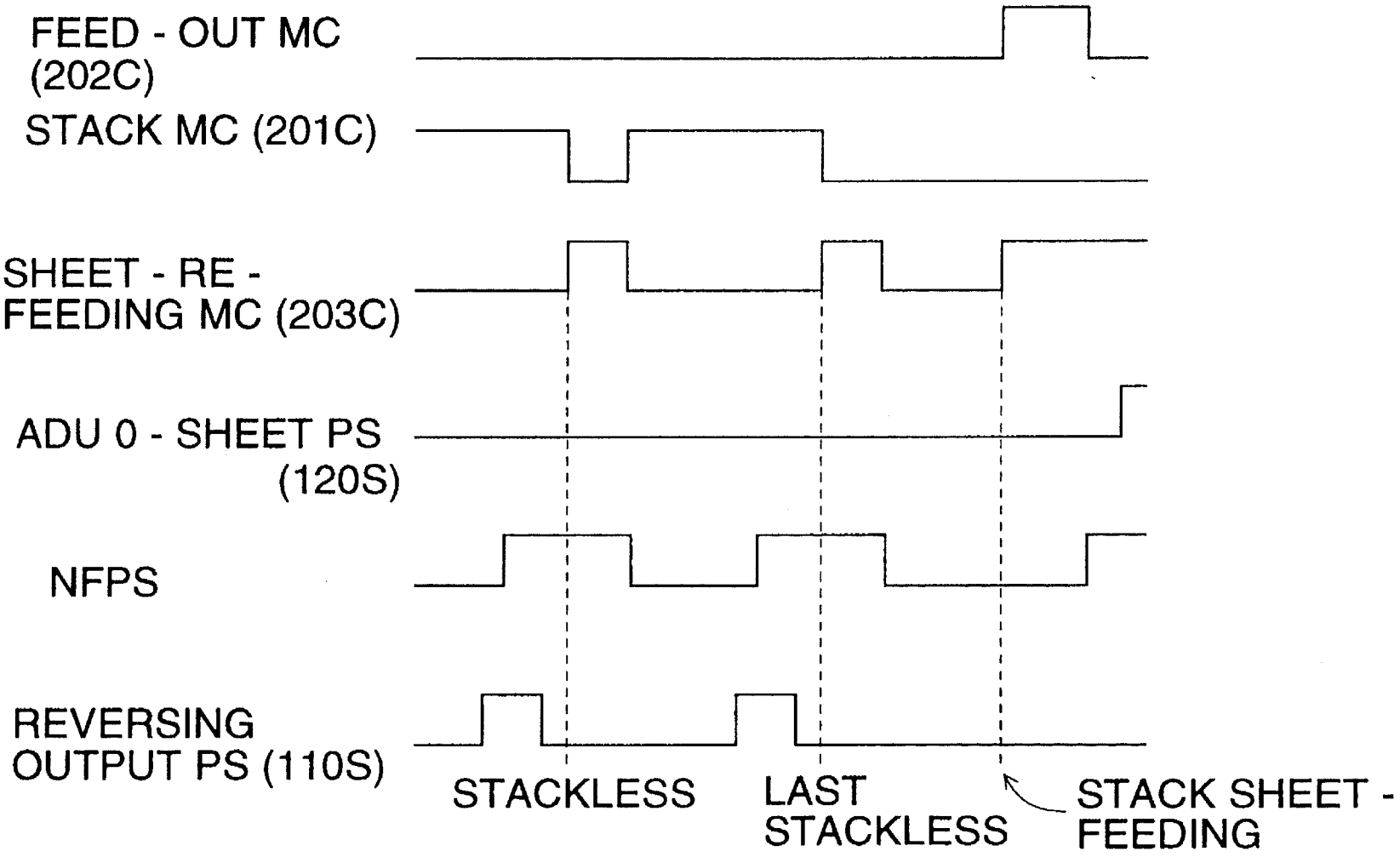
FIG. 5 is a time chart showing how the forward/reverse rotation roller in the intermediate stacker is controlled.

Incidentally, in the time chart in FIG. 3, an ending point for the forwarding operation of the scanning optical system is controlled and operations of a registration clutch are controlled both with the reference of signals from a photosensor for the reference of the optical system. In FIG. 3, a stacked sheet is conveyed following the 5th stackless sheet. FIG. 5 is a time chart showing how the forward/reverse rotation roller of a switchback means 110 provided at the port of intermediate stacker 120 is controlled. Incidentally, ADU0 sheet-PS (120S) is a photosensor for checking existence of recording sheets in the intermediate stacker 120.

In a two-sided copying apparatus of the invention, a binding margin mode can be set, and a binding margin is obtained by shifting images. For obtaining the binding margin, therefore, it is necessary to move the timing for making registration MC (45C) to be ON from the timing for no image shifting.

When the timing for registration MC (45C) to be ON is earlier for the obverse side of a recording sheet and is later for the reverse side thereof, recording sheet S returns to registration roller 45 earlier because the registration roller (45) is caused to be ON earlier than the ordinary case for copying for the obverse side. Further, the subsequent recording sheet also returns earlier. Therefore, the scanning optical system is returned earlier than usual for the start of exposure scanning for the reverse side.

When the timing for registration MC (45C) to be ON is later for the obverse side of a recording sheet and is earlier for the reverse side thereof, recording sheet S returns to registration roller 45 later because the registration roller (45) is caused to be ON later than the ordinary case for the obverse side. In this case, the waiting time for the optical scanning system is increased.

Figure 6:
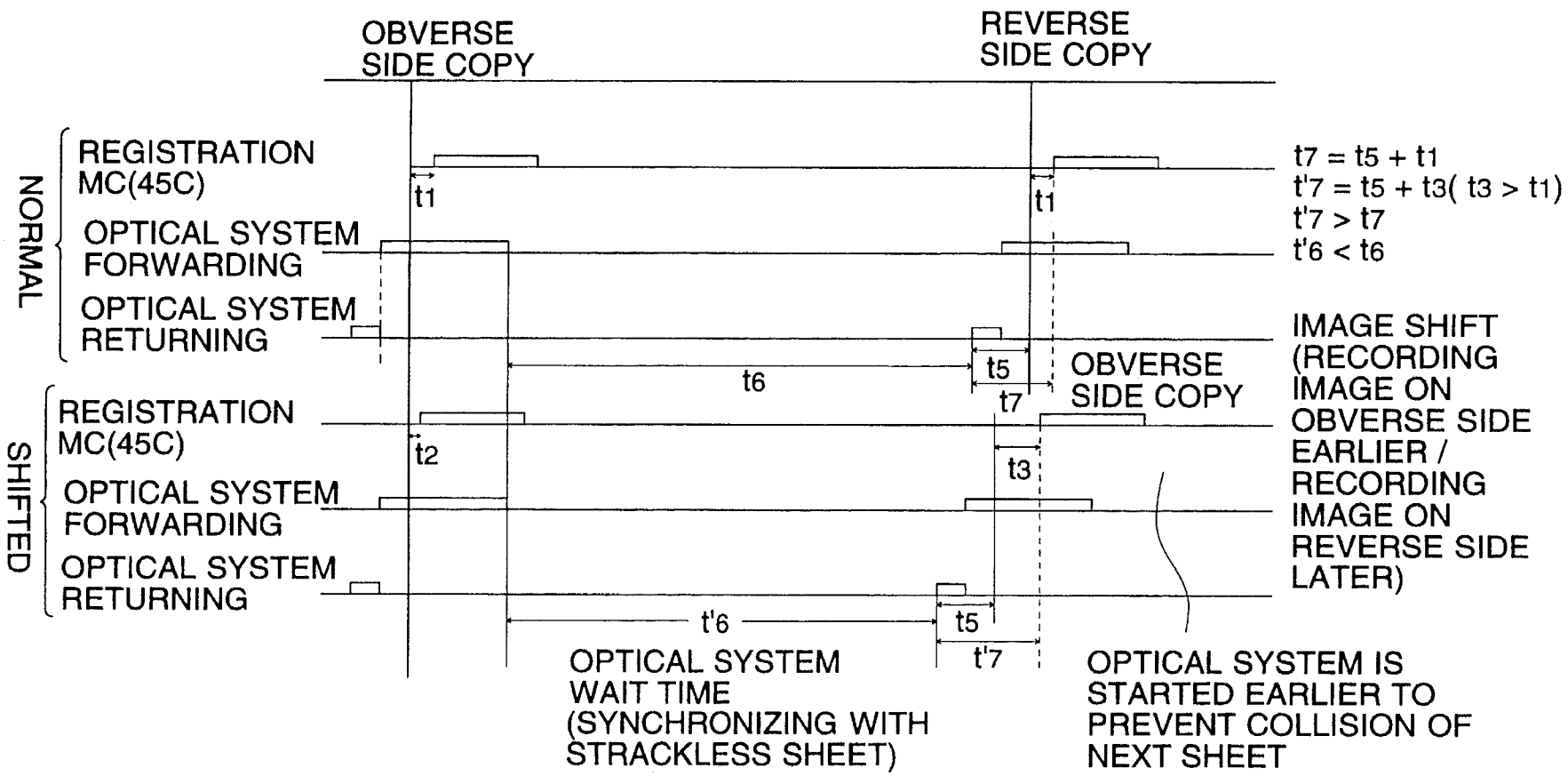
FIG. 6 is a time chart in a binding margin mode.

FIG. 6 is a time chart showing the relation between the occasion including image shifting based on a binding margin mode and the occasion including no image shifting through comparison with a single sheet setting (showing that an image on the recording sheet is recorded earlier for the obverse side and it is recorded later for the reverse side).

Therefore, when correcting, corresponding to an amount of image shift, the time (T1) obtained by adding the time for temporary stop to the time period from the moment when the registration MC (45C) is caused to be ON without aforementioned image shift under a stackless mode to the moment when the recording sheet returns to the registration roller (45C) and when processing with the corrected time (T1') in accordance with the flow chart shown in FIG. 4, the number of sheets to be stacked, the number of stackless sheets and the optical system waiting time all corresponding to the amount of image shift can be obtained.

In the present invention, it is possible to absorb the fluctuation of one copy cycle time without storing cycle time periods which are countless due to the variation of sheet size×magnification, because one copy cycle time can be measured during copying operations. It is therefore possible to provide a two-sided copying apparatus wherein optimum conditions can be established and the substantial copy speed can be maintained to be optimum while the conformity and reliability as a system are kept. Further, in the two-sided copying apparatus of the invention, when a binding margin mode is established, returning timing of the optical system and the number of stackless sheets are set depending on an amount of the binding margin, and thereby the rear-end collision and jamming of recording sheets can be prevented.

What is claimed is:

1. An apparatus for recording an image on two sides of a recording sheet, the apparatus comprising:

(a) image forming means for forming an image on recording sheets;

(b) a sheet feeder for feeding the recording sheets one by one from a sheet storing tray into said image forming means;

(c) an intermediate stacker for stacking the recording sheets after an image is formed on one side of each of the recording sheets, said stacker having a passage through which the recording sheets are fed into said intermediate stacker and through which the recording sheets are fed out from said intermediate stacker when an image is to be formed on an opposite side of each of the recording sheets;

(d) feeding means for feeding the recording sheets into said intermediate stacker or for feeding the recording sheets out from the intermediate stacker when the recording sheets are stacked in said intermediate stacker;

(e) means for switching a conveyance path of the recording sheets proximate to the passage of said intermediate stacker;

(f) a conveyor for conveying the recording sheets from said switching means to said image forming means;

(g) a controller for switching between a stackless mode in which said conveyor conveys the recording sheets one by one from said switching means to said image forming means without stacking the recording sheet in said intermediate stacker, and a stack mode in which said conveyor conveys the recording sheets one by one to said image forming means after the recording sheets are stacked in said intermediate stacker;

(h) setting means for setting a recording quantity; and (i) first measuring means for measuring a period of time for a copy cycle in which an image is formed on one side of one of the recording sheets, such that said controller switches between the stackless mode and the stack mode by determining a number of the recording sheets to be recorded in the stackless mode and a number of the recording sheets to be recorded in the stack mode according to the period of time measured by said first measuring means and the recording quantity of said setting means.

2. The image recording apparatus of claim 1, further comprising:

a returning controller for controlling return timing of an optical scanning system of said apparatus; and second measuring means for measuring time required for a first recording sheet in the stackless mode to reach said switching means, wherein the returning controller controls the return timing of the optical scanning system based on said time measured by said second measuring means to start a return after completion of a last image forming exposure on one side of the recording sheets.

3. The image recording apparatus of claim 1, wherein a distance between a first recording sheet in the stackless mode and a last recording sheet having an image recorded on one side thereof is longer than a distance between two of the recording sheets.

4. The image recording apparatus of claim 1, wherein a period of time corresponding to a distance between a first recording sheet in the stackless mode and a last recording sheet having an image recorded on one side thereof is longer than a period of time required to replace an original document to be recorded.

5. The image recording apparatus of claim 1, wherein said controller determines the number of recording sheets to be recorded in the stackless mode according to a length of a conveying path between said sheet storing tray and said switching means.

6. The image recording apparatus of claim 5, wherein said controller determines the number of recording sheets to be recorded in the stackless mode by subtracting one from a maximum number of recording sheets lacking collision in the stackless mode so that the recording sheets can be placed along the conveying path between said sheet storing tray and said switching means.

7. The image recording apparatus of claim 5, further comprising:

a detector for detecting presence of the recording sheets on said sheet storing tray such that said detector detects the presence of the recording sheets before a first recording sheet to be recorded in the stackless mode reaches said switching means.

8. The image recording apparatus of claim 7, wherein when the presence of the recording sheets is not detected by said detector in the stackless mode the recording sheets present in the conveying path are temporarily stored in said intermediate stacker.

9. The image recording apparatus of claim 1 further comprising:

means for forming a binding margin on the recording sheets by shifting an image forming position of said image forming means on the recording sheets, such that said controller determines the number of recording sheets to be recorded in the stackless mode according to shifting amount of the image forming position.

10. The image recording apparatus of claim 1, wherein said controller switches between the stackless mode and the stack mode so that the recording quantity is equal to the sum of a total number of recording sheets to be recorded in the stackless mode and a total number of recording sheets to be recorded in the stack mode.

* * * * *